United States Patent [19]

Arada

[11] Patent Number: 4,658,567

[45] Date of Patent: Apr. 21, 1987

[54] MULTI-DENSITY POLYURETHANE FOAM PACKING UNIT AND METHOD OF MAKING SAME

[76] Inventor: Carl T. Arada, 2718 Teagarden St., San Leandro, Calif. 94577

[21] Appl. No.: 350,208

[22] Filed: Feb. 19, 1982

Related U.S. Application Data

[62] Division of Ser. No. 238,009, Feb. 25, 1981, abandoned.

[51] Int. Cl.[4] ..... B65B 23/00

[52] U.S. Cl. ..... 53/472; 53/474; 206/524; 206/592; 428/71; 428/170

[58] Field of Search ..... 428/71, 170, 217, 218, 428/316.6; 264/46.5, 46.8; 53/472, 474, 141; 206/523, 524, 592

[56] References Cited

U.S. PATENT DOCUMENTS

| | | | |
|---|---|---|---|
| 3,181,693 | 5/1965 | Freistat | 206/523 |
| 3,187,669 | 6/1965 | Pincus | 264/46.6 |
| 3,222,843 | 12/1965 | Schneider | 206/524 X |
| 3,275,131 | 9/1966 | Erickson | 206/523 |
| 3,311,231 | 3/1967 | English | 206/523 |
| 3,520,769 | 7/1970 | Baker | 428/316.6 |
| 3,618,287 | 11/1971 | Gobhai | 53/472 |
| 3,708,946 | 1/1973 | Cahill | 206/523 |
| 3,864,206 | 2/1975 | Linderoth | 264/46.8 X |
| 3,871,521 | 3/1975 | Szatkowski | 53/474 X |
| 4,022,317 | 5/1977 | Burgeson | 206/523 |
| 4,030,267 | 6/1977 | Arnaud | 53/47 X |
| 4,144,296 | 3/1979 | Dickens | 264/46.5 X |
| 4,190,697 | 2/1980 | Harens . | |
| 4,304,810 | 12/1981 | Gates | 428/218 |

FOREIGN PATENT DOCUMENTS

| | | | |
|---|---|---|---|
| 2036276 | 12/1970 | France | 264/46.8 |
| 820966 | 9/1959 | United Kingdom | 264/46.8 |
| 1009156 | 11/1965 | United Kingdom | 206/523 |

*Primary Examiner*—John Sipos

*Attorney, Agent, or Firm*—Harris Zimmerman; Howard Cohen

[57] ABSTRACT

A polyurethane foam packing unit formed in desired cross-sectional configuration and having a relatively low density. A block which may also be formed of polyurethane or the like is disposed within the unit, and possesses a higher density than that of the mass. A polyurethane flexible liner encompasses the mass and the block embedded therein. The invention further incorporates the method of producing such a unit.

2 Claims, 4 Drawing Figures

MULTI-DENSITY POLYURETHANE FOAM PACKING UNIT AND METHOD OF MAKING SAME

This is a division, of application Ser. No. 238,009, filed Feb. 25, 1981, abandoned.

BACKGROUND OF THE INVENTION

The use of polyurethane foam or similar formulations as packing material has become widespread for a number of reasons, including its relative low cost, ease of molding into desired cross-sectional configuration to match the contour of an article being packaged or transported, and its ability to withstand shock loads to protect such an article. Normally, the person designing the package or packing unit is required to select a foam density which is sufficient for properly supporting the portions of the article at which maximum loading conditions are present, even though this results in a foam mass having an excessively high density adjacent other portions of the article. Since the packing unit manufacturing cost is dependent in part on the density of the foam being used, a wasteful situation prevails; additionally the higher density foam results in a greater than necessary weight for the packing unit, resulting in added shipping costs.

SUMMARY OF THE PRESENT INVENTION

In accordance with the teachings of the present invention, the packing unit may be formed of polyurethane or similar foam material having a relatively low density, and contoured to properly receive the article being packaged or shipped. In those portions of the unit whereat greater loads or stress concentration occur, the low density foam is replaced by a block or body of higher density foam or the like which is capable of absorbing loads greater than that of the low density foam. Also, pursuant to the teachings of this invention, a new method or process is provided wherein the higher density block is inserted in a mold in its proper position prior to the introduction of the liquid foam into the mold. The block is thus generally encapsulated within the low density foam as the latter is cured.

Typical prior art references teaching the general art of producing foam articles, and the formulations thereof, include U.S. Pat. Nos. 4,190,679, 3,222,843, and 4,144,296.

A BRIEF DESCRIPTION OF THE DRAWING

DESCRIPTION OF THE PREFERRED EMBODIMENT

Figure 4:
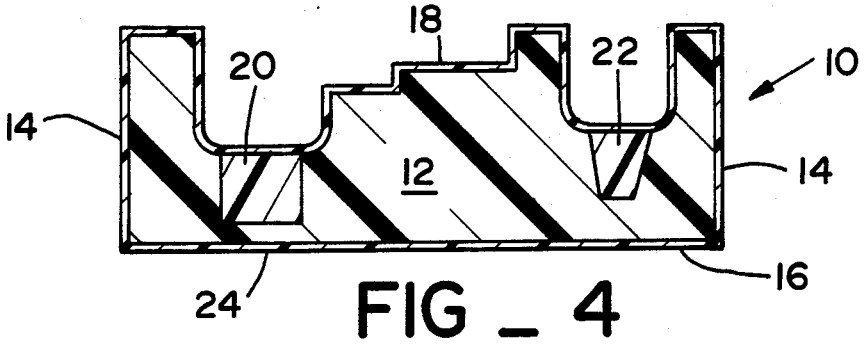
FIG. 4 is a cross-sectional view of the finished product.

The packing unit of the present invention is generally designated by the numeral 10 in FIG. 4 of the drawing. The particular cross-sectional configuration has no special significance, but is merely illustrative of a shape or contour adapted to receive an article (not shown) having a complementary shape or configuration. It should also be understood that the unit 10 comprises only one part of the entire shipping unit, since there will usually be a cover or upper section which may have a similar or different internal shape, depending, of course, on the shape of the article inserted between the two packing unit sections.

The section 10 is formed of a generally homogeneous mass of cured polyurethane foam 12 having, for example, opposed flat side walls 14, a flat bottom wall 16, and the previously discussed upper contoured wall 18. The foam body 12 is of a light weight or low density character, e.g., about 3 to 4 pounds per cubic foot. However, embedded in the body 12 are one or more blocks 20, 22 of a stronger and higher density material. Block 20 is shown generally rectangular and block 22 of frustoconical shape, but these are for illustration only, and their position in the body mass 12 and their specific shapes will be determined by the nature and extent of the concentrated loads placed on the foam support. The blocks may also be formed of a foam material such as polyurethane or polystyrene, and might have a density of, for example, up to 9 pounds per cubic foot. The blocks could be formed of other materials as well.

Surrounding the body 12 and the blocks 20 and 22 disposed therein, is a protective envelope or liner 24 which may constitute a relatively thin flexible sheet of plastic such as polyethylene or the like. The liner 24 protects the somewhat frangible mass 12 from crumbling, absorbing water, or otherwise getting damaged.

The unit 10 will thus receive an article to be packaged or shipped, the article being supported on the upper wall surface 18 of the body, and specifically further supported in areas of higher loading or stress concentrations by the blocks 20 and 22.

Figure 1:
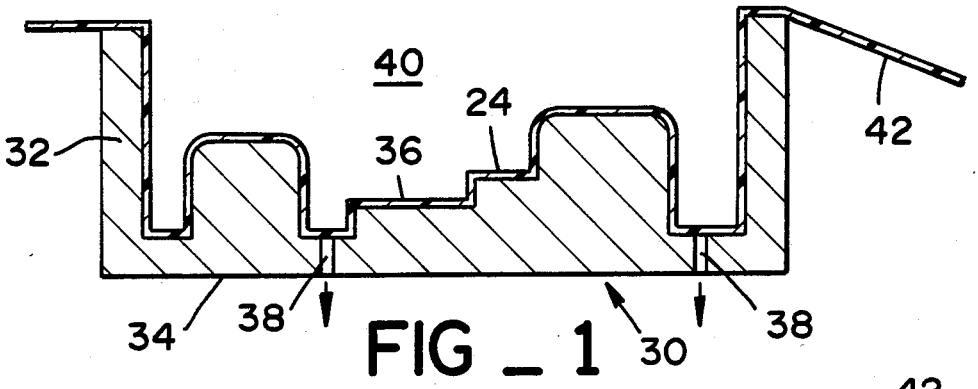
FIG. 1 is a cross-sectional view of the denser mold section with the liner positioned therein.
Figure 2:
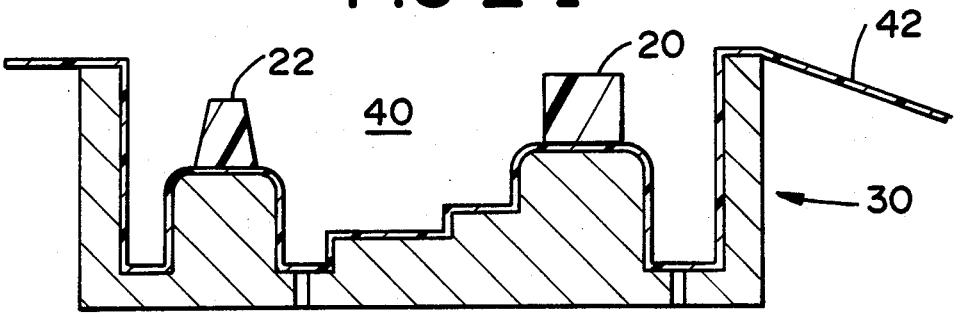
FIG. 2 is a view similar to FIG. 1, and further including the placing of relative high density blocks in the mold.
Figure 3:
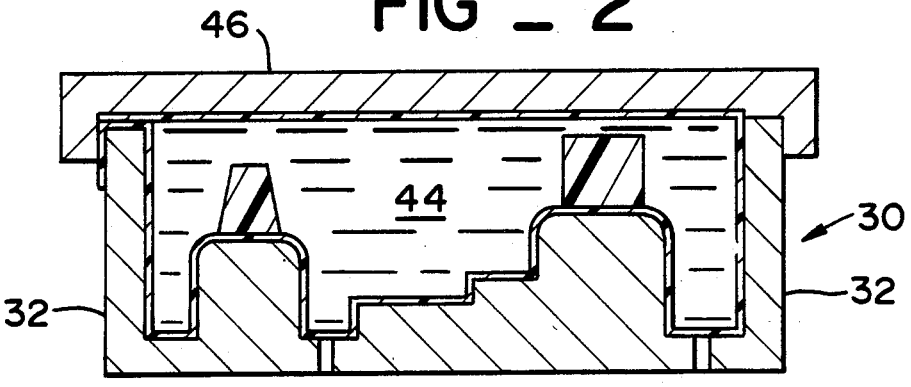
FIG. 3 is a view similar to FIG. 2, but illustrating the filling of the lesser mold section with liquid foam and placing the upper lid over the lower mold section.

To produce the unit 10, reference is made to FIGS. 1, 2, and 3 of the drawing which is generally diagrammatic and descriptive of the method employed.

First, a lower mold 30 is utilized, such mold having side walls 32, a base 34, and an upper surface 36 having a contour or configuration complementary to the wall 18 of the finished molded article. The plastic liner 24 is draped over the surface 36 and the interior of the side walls 32 and drawn thereagainst, such as by means of a vacuum induced through apertures 38 placed in locations along the molded and extending from exteriorly thereof into the mold cavity 40. The ends 42 of the cover extend beyond the sides of the mold.

Next, as shown in FIG. 2, the blocks 20, 22 are placed in the cavity 40 at the desired locations.

Finally, as shown in FIG. 3, liquid foam 44 is inserted into the cavity 40 and around the blocks. The plastic ends 42 of the liner 24 are brought over the liquid foam, and an upper mold section, such as cover 46, is placed over the lower mold sector 30. The liquid foam is cured and solidifies within the liner 24 and around the blocks. After curing, the mold sections are separated and the unit 10 is removed.

I claim:

1. A method of packaging and protecting articles for shipping and the like, comprising the steps of:

providing a mold having one surface three-dimensionally configured generally the same as one three-dimensionally configured surface of the article and further having generally planar adjacent side walls;

covering the three-dimensionally configured surface and side walls of the mold with a flexible liner sheet;

placing a plurality of preformed, resilient foam resin block members within said mold on said liner sheet at preselected locations to provide augmented resilient support to portions of said article;

foaming synthetic resin chemicals within said mold to encapsulate and suspend said block members in the foaming chemicals and generally fill said mold;

placing a cover sheet over the top of said mold and restraining the foaming chemicals with a flat mold top wall opposing the three-dimensionally configured surface of the mold, said block members being spaced from said flat mold top wall by said foaming chemicals disposed therebetween;

curing the foam to a density substantially less than the density of said block members to form a homogeneous one-piece mass of synthetic resin foam material having two opposing side walls, a three-dimensionally configured wall and a planar wall opposing said three-dimensionally configured wall spaced from said block members corresponding to those of the mold that are covered and enveloped by the liner and higher density resilient foam resin block members disposed to augment support of portions of said article to form a packing unit comprising the cover and liner sheets, mass of foam and block members; and packaging the article by placing the article on the packing unit with said portions of said article impinging on said higher density foam block members, said article being in mating engagement with and in substantially full contact with the three-dimensionally configured surface of the cured foam with liner sheet.

2. The method of claim 1, wherein said foaming and curing are conducted so that said block members remain in contact with the liner sheet;

said step of covering the three-dimensionally configured surface and said side walls with the cover sheet includes providing the cover sheet as a homogeneous extension of the liner sheet connected thereto by a fold line; and the density of said block members is up to about 9 pounds per cubic foot.

* * * * *